US009350102B2

(12) United States Patent
Wu

(10) Patent No.: US 9,350,102 B2
(45) Date of Patent: May 24, 2016

(54) METAL LEAF-SPRING-TYPE CONNECTOR FOR ELECTRONIC CIGARETTE DEVICES

(71) Applicant: SHENZHEN SMACO TECHNOLOGY LIMITED, Shenzhen, Guangdong Province (CN)

(72) Inventor: Yangyang Wu, Shenzhen (CN)

(73) Assignee: SHENZHEN SMACO TECHNOLOGY LIMITED, Shenzhen, Guangdong Province (CN)

( * ) Notice: Subject to any disclaimer, the term of this patent is extended or adjusted under 35 U.S.C. 154(b) by 114 days.

(21) Appl. No.: 14/488,311

(22) Filed: Sep. 17, 2014

(65) Prior Publication Data

US 2015/0325938 A1 Nov. 12, 2015

(30) Foreign Application Priority Data

May 12, 2014 (CN) ..... 2014 2 0238503

(51) Int. Cl.
*H01R 11/22* (2006.01)
*H01R 13/11* (2006.01)
*A24F 47/00* (2006.01)

(52) U.S. Cl.
CPC ..... *H01R 13/111* (2013.01); *A24F 47/008* (2013.01)

(58) Field of Classification Search
CPC ..... H01R 4/10; H01R 4/2495; H01R 9/0518; H01R 13/15; H01R 13/052; H01R 13/111; H01R 13/187; A24F 47/002; A24F 47/008
USPC ..... 439/851, 842, 843, 852, 854, 322
See application file for complete search history.

(56) References Cited

U.S. PATENT DOCUMENTS 4,377,320 A * 3/1983 Lathrop ..... H01R 24/40 439/585
4,593,464 A * 6/1986 Williams ..... H01R 4/10 228/136
4,662,706 A * 5/1987 Foley ..... H01R 13/187 439/843
4,988,314 A * 1/1991 Sardar ..... H01R 24/40 439/628
5,147,221 A * 9/1992 Cull ..... H01R 24/40 439/585
5,882,233 A * 3/1999 Idehara ..... H01R 4/20 439/585
9,010,335 B1 * 4/2015 Scatterday ..... A24F 47/008 128/202.21
2015/0053218 A1 * 2/2015 Liu ..... A61M 11/042 131/329

FOREIGN PATENT DOCUMENTS

WO WO 2015013891 A1 * 2/2015 ..... A24F 47/008

* cited by examiner

*Primary Examiner* — Neil Abrams
*Assistant Examiner* — Travis Chambers
(74) *Attorney, Agent, or Firm* — Cheng-Ju Chiang

(57) ABSTRACT

The present invention discloses a metal leaf-spring-type connector used for electronic cigarette devices. The connector comprises a leaf spring component and a connector component. The leaf spring component comprises a central columnar negative electrode leaf spring, and at least one positive electrode leaf spring disposed outside the negative electrode leaf spring. The connector component comprises a hollow central columnar negative electrode connector, and a positive electrode connector disposed outside the negative electrode connector. When the leaf spring component and the connector component are inserted and plugged together, the negative electrode leaf spring is inserted into the circular hole of the negative electrode connector to electrically connect with the negative electrode connector. The positive electrode connector is inserted into a void between the negative electrode leaf spring and the positive electrode leaf spring.

3 Claims, 2 Drawing Sheets

METAL LEAF-SPRING-TYPE CONNECTOR FOR ELECTRONIC CIGARETTE DEVICES

BACKGROUND OF THE INVENTION

1. Field of the Invention

The present invention relates to a metal leaf-spring-type connector, particularly with regard to a metal leaf-spring-type connector used for connecting atomizing components and battery components of electronic cigarette devices.

2. The Related Arts

Electronic cigarettes, also known as virtual cigarettes or electronic atomizers, are mainly used for smoke quitting and substituting actual cigarettes. Electronic cigarettes have a same appearance as and similar taste to actual cigarettes. Some electronic cigarettes even have more tastes than general actual cigarettes. Electronic cigarettes can be used to suck out smoke and flavors therein, and to gain feelings of inhaling and exhaling like actual cigarettes. In addition, electronic cigarettes have no other harmful ingredients in actual cigarettes, such as tar and suspended particles, etc. Hence, electronic cigarettes have become the best choice to replace cigarettes.

Existing electronic cigarettes in the market are all designed to adopt screwed connection. Screw thread lengths, screw pitch and other parameters of such designs are generally short and small. Since power sources of electronic cigarettes are usually rechargeable batteries, connection of power supply parts and atomizer parts of electronic cigarettes is extremely affected by frequently dismantling and assembling because of battery charging. The screw thread thereof is easy to be worn out and result in being misplaced or becoming malfunction. Meanwhile, it is also time consuming to adopt designs of screw connection.

SUMMARY OF THE INVENTION

The main objective of the present invention is to provide a metal leaf-spring-type connector used for connection of electronic cigarette devices based on deficiencies of the prior art mentioned above. The metal leaf-spring-type connector of the present invention is convenient to be dismantled and assembled, is effective to save time of being dismantled and assembled, and is effective to protect related products for long-term uses.

The present invention adopts technical solutions as follows. A metal leaf-spring-type connector in accordance with the present invention comprises a leaf spring component fixed at one end of a battery component of an electronic cigarette device, and a connector component fixed at one end of an atomizing component of the electronic cigarette device. The leaf spring component comprises a central columnar negative electrode leaf spring, and at least one positive electrode leaf spring disposed outside the negative electrode leaf spring. An inward curved protrusion is formed at a middle of the positive electrode leaf spring. The connector component comprises a hollow central columnar negative electrode connector, and a positive electrode connector disposed outside the negative electrode connector. A circular hole is formed at a center of the negative electrode connector for insertion of the negative electrode leaf spring therein. The positive electrode connector is cylindrical and an inwardly recessed circular groove is formed at and around the positive electrode connector. When the leaf spring component and the connector component are inserted and plugged together, the negative electrode leaf spring is inserted into the circular hole of the negative electrode connector to electrically connect with the negative electrode connector. The positive electrode connector is inserted into a void between the negative electrode leaf spring and the positive electrode leaf spring, and the groove of the positive electrode connector and the protrusion of the positive electrode leaf spring are gripped and engaged with each other.

Preferably, a cover is formed between two of the at least one positive electrode leaf spring.

Preferably, an amount of the at least one positive electrode leaf spring is two or more, and the two or more of the at least one positive electrode leaf spring are distributed uniformly around the negative electrode leaf spring.

The present invention has beneficial advantages that a connecting style of atomizing components and battery components is changed from a traditional screwed connection to a leaf-spring-type connection. As a result, the metal leaf-spring-type connector of the present invention is convenient to be dismantled and assembled, is effective to save time of being dismantled and assembled, and is effective to protect related products for long-term uses.

DETAILED DESCRIPTION OF PREFERRED EMBODIMENT

In order to much explicitly express the present invention, the following descriptions accompanying attached drawings are presented to further describe the present invention.

Figure 1:
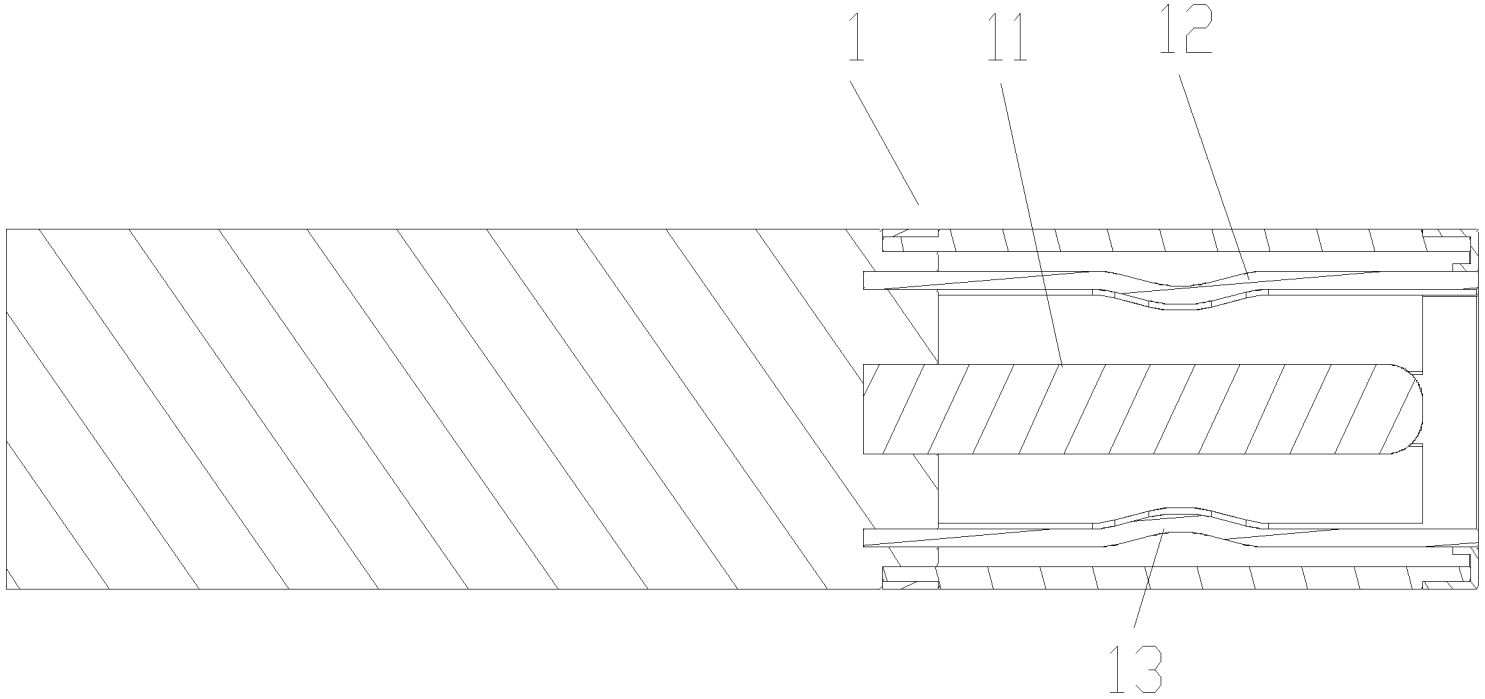
FIG. 1 shows a structural schematic sectional view of a first group of components of a metal leaf-spring-type connector in accordance with the present invention.
Figure 2:
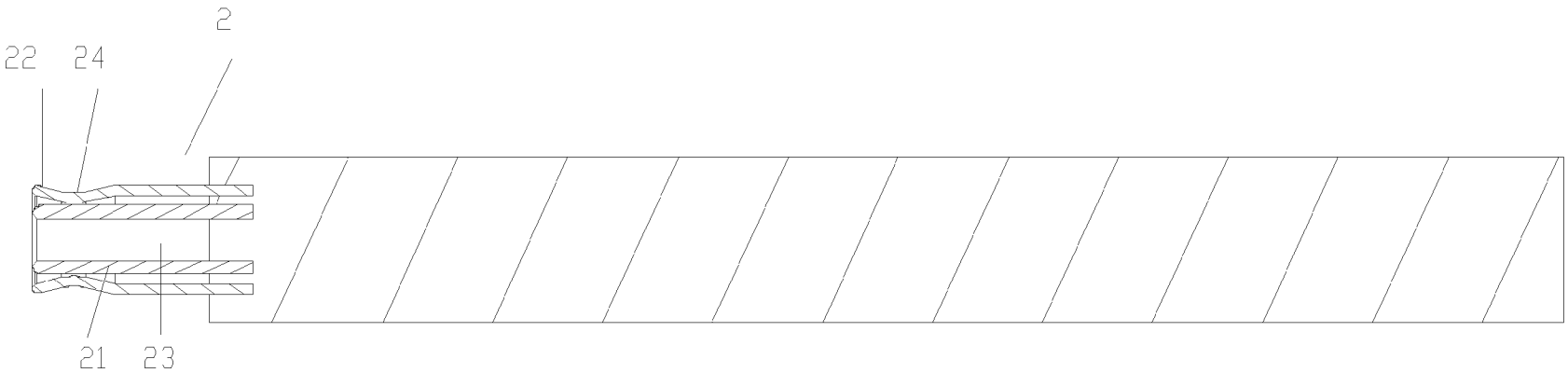
FIG. 2 shows a structural schematic sectional view of a second group of components of a metal leaf-spring-type connector in accordance with the present invention.

With reference to FIGS. 1 to 2, a metal leaf-spring-type connector in accordance with the present invention comprises a leaf spring component 1 fixed at one end of a battery component (Shown in FIG. 1 without being labeled) of an electronic cigarette device, and a connector component 2 fixed at one end of an atomizing component (Shown in FIG. 2 without being labeled) of the electronic cigarette device. The leaf spring component 1 comprises a central columnar negative electrode leaf spring 11, and at least one positive electrode leaf spring 12 disposed outside the negative electrode leaf spring 11. An inward curved protrusion 13 is formed at a middle of the positive electrode leaf spring 12. The connector component 2 comprises a hollow central columnar negative electrode connector 21, and a positive electrode connector 22 disposed outside the negative electrode connector 21. A circular hole 23 is formed at a center of the negative electrode connector 21 for insertion of the negative electrode leaf spring 11 therein. The positive electrode connector 22 is cylindrical and an inwardly recessed circular groove 24 is formed at and around the positive electrode connector 22. When the leaf spring component 1 and the connector component 2 are inserted and plugged together, the negative electrode leaf spring 11 is inserted into the circular hole 23 of the negative electrode connector 21 to electrically connect with the negative electrode connector 21. The positive electrode connector 22 is inserted into a void between the negative electrode leaf spring 11 and the positive electrode leaf spring 12, and the groove 24 of the positive electrode connector 22 and the protrusion 13 of the positive electrode leaf spring 12 are gripped and engaged with each other.

In the present embodiment, a cover is formed between two of the at least one positive electrode leaf spring 12 in order to constitute an outer shell surrounding the negative electrode leaf spring 11 for protection of the positive electrode connector 22 inserted therein.

In the present embodiment, an amount of the at least one positive electrode leaf spring 12 is two, and the two of the at least one positive electrode leaf spring 12 are distributed at two opposite sides of the negative electrode leaf spring 11.

Disclosed above is only a specific embodiment of the present invention. However, the present invention is not intended to limit as depicted above. Any technical person skilled in the technical art can think of variations which are still covered and fallen within the inventive spirit of the present invention and the claimed scope as defined in the following claims.

What is claimed is:

1. A metal leaf-spring-type connector, comprising a leaf spring component fixed at one end of a battery component of an electronic cigarette device, and a connector component fixed at one end of an atomizing component of the electronic cigarette device, the leaf spring component comprising a central columnar negative electrode leaf spring, and at least one positive electrode leaf spring disposed outside the negative electrode leaf spring, an inward curved protrusion formed at a middle of each of the at least one positive electrode, the connector component comprising a hollow central columnar negative electrode connector, and a positive electrode connector disposed outside the negative electrode connector, a circular hole formed at a center of the negative electrode connector for insertion of the negative electrode leaf spring therein, the positive electrode connector being cylindrical and an inwardly recessed circular groove formed at and around the positive electrode connector, wherein when the leaf spring component and the connector component are inserted and plugged together, the negative electrode leaf spring is inserted into the circular hole of the negative electrode connector to electrically connect with the negative electrode connector, the positive electrode connector is inserted into a void defined between the negative electrode leaf spring and the at least one positive electrode leaf spring, and the groove of the positive electrode connector and the protrusion of the each of the at least one positive electrode leaf spring are gripped and engaged with each other.

2. The metal leaf-spring-type connector as claimed in claim 1, wherein a cover is formed between two of the at least one positive electrode leaf spring.

3. The metal leaf-spring-type connector as claimed in claim 1, wherein an amount of the at least one positive electrode leaf spring is two or more, and the two or more of the at least one positive electrode leaf spring are uniformly distributed around the negative electrode leaf spring.

* * * * *